US012616247B2

(12) United States Patent
Qiu

(10) Patent No.: US 12,616,247 B2
(45) Date of Patent: May 5, 2026

(54) AEROSOL GENERATING DEVICE AND ATOMIZER WITH IMPROVED AIRFLOW AND LEAKAGE PREVENTION

(71) Applicant: Changzhou Patent Electronic Technology Co., LTD., Changzhou City (CN)

(72) Inventor: Weihua Qiu, Changzhou City (CN)

(73) Assignee: CHANGZHOU PATENT ELECTRONIC TECHNOLOGY CO., LTD., Changzhou City (CN)

( * ) Notice: Subject to any disclaimer, the term of this patent is extended or adjusted under 35 U.S.C. 154(b) by 425 days.

(21) Appl. No.: 18/141,371

(22) Filed: Apr. 29, 2023

(65) Prior Publication Data

US 2024/0016211 A1 Jan. 18, 2024

Related U.S. Application Data

(63) Continuation-in-part of application No. PCT/CN2021/112003, filed on Aug. 11, 2021.

(30) Foreign Application Priority Data

Oct. 29, 2020 (CN) ..... 202022461190.0

(51) Int. Cl.
*A24F 40/46* (2020.01)
*A24F 40/10* (2020.01)
*A24F 40/485* (2020.01)

(52) U.S. Cl.
CPC ..... *A24F 40/46* (2020.01); *A24F 40/10* (2020.01); *A24F 40/485* (2020.01)

(58) Field of Classification Search
CPC ..... A24F 40/10; A24F 40/46; A24F 40/48; A24F 40/485
See application file for complete search history.

(56) References Cited

U.S. PATENT DOCUMENTS

2019/0335813 A1 11/2019 Qiu
2020/0352238 A1* 11/2020 Simpson ..... A24F 40/44
2023/0000161 A9* 1/2023 Zhou ..... A24F 40/465

FOREIGN PATENT DOCUMENTS

CN 205831086 U 12/2016
CN 209518261 U 10/2019
(Continued)

OTHER PUBLICATIONS

Translation of CN 210929645 U (Year: 2020).*

*Primary Examiner* — Michael H. Wilson
*Assistant Examiner* — Michael Patrick Mullen
(74) *Attorney, Agent, or Firm* — Cheng-Ju Chiang

(57) ABSTRACT

An atomizer includes an atomizing housing and an atomizing base. The lower end of the atomizing housing is connected to the upper end of the atomizing base. A communicating hole is provided at the bottom of the atomizing housing to allow an atomizing chamber in the atomizing housing to communicate with the inner cavity of the atomizing base. A partition plate is provided within the inner cavity of the atomizing base and divides the inner cavity of the atomizing base into a liquid storage cavity and a ventilation cavity. An opening is provided at the upper end of the partition plate. The opening is used for communicating the liquid storage cavity with the ventilation cavity. The liquid storage cavity is located directly below the communicating hole. The ventilation cavity is located away from the underside of the communicating hole.

16 Claims, 8 Drawing Sheets

(56) References Cited

FOREIGN PATENT DOCUMENTS

| | | | | |
|---|---|---|---|---|
| CN | 210203316 | U | | 3/2020 |
| CN | 111134363 | A | | 5/2020 |
| CN | 210929645 | U | * | 7/2020 |
| CN | 210960416 | U | | 7/2020 |
| CN | 210988226 | U | | 7/2020 |
| CN | 211431065 | U | | 9/2020 |
| CN | 213695701 | U | | 7/2021 |
| WO | 2020/182068 | A1 | | 9/2020 |
| WO | 2022/088845 | A1 | | 5/2022 |

* cited by examiner

AEROSOL GENERATING DEVICE AND ATOMIZER WITH IMPROVED AIRFLOW AND LEAKAGE PREVENTION

CROSS REFERENCE TO RELATED APPLICATIONS

The present disclosure is a continuation-in-part of International Patent Application No. PCT/CN2021/112003, filed on Aug. 11, 2021, which claims priority to Chinese Patent Applications No. 202022461190.0, filed on Oct. 29, 2020. All of the aforementioned patent applications are hereby incorporated by reference in their entireties.

BACKGROUND OF THE APPLICATION

Field of the Application

The present disclosure relates to an aerosol generating device and an atomizer.

Description of Related Art

The aerosol generating device is an electronic product that simulates cigarettes, and it is an alternative vaping device for users to inhale by heating and atomizing the e-liquid. Compared with traditional cigarettes, the aerosol generating devices are easy to use and contain fewer harmful substances.

At present, on the market, the aerosol generating device generally has a direct connection between the ventilation hole of the atomizing base and the heating wire. During the atomization process, the condensate directly flows out from the ventilation hole of the atomizing base, and directly flows to the bottom of the atomizing base, which brings great inconvenience to consumers.

The aerosol generating device with an airflow switch is one type of the aerosol generating devices, when the airflow passes through the airflow switch, the circuit is turned on, so that the aerosol generating device is very convenient to use. In the existing aerosol generating devices, the airflow switch is generally set at the bottom of the cigarette rod, the flow direction of the airflow is that the airflow enters from the bottom of the cigarette rod, passes through the airflow switch, the battery and the conductive seat, then flows into the atomizer to be mixed with the atomized e-liquid, and is finally inhaled into the user's mouth. The airflow channel of this aerosol generating device is long, and the battery will swell when it is used improperly, which will increase the resistance of the airflow. The user feels difficult when inhaling, and the generated smoke is less. The user experience is not good.

BRIEF SUMMARY OF THE APPLICATION

The object of the present disclosure is to overcome the defects of the prior art, and provide an aerosol generating device and an atomizer, which can realize double leakage prevention and can effectively ensure the smoothness of the user's inhalation, and has a good user experience.

The technical solution adopted by the present disclosure to solve the problem is as follows:

The present disclosure provides an atomizer which includes an atomizing housing and an atomizing base. The lower end of the atomizing housing is connected to the upper end of the atomizing base. The bottom of the atomizing housing is provided with a communicating hole to allow an atomizing chamber in the atomizing housing to communicate with the inner cavity of the atomizing base. A partition plate is provided in the inner cavity of the atomizing base, and the partition plate divides the inner cavity of the atomizing base into a liquid storage cavity and a ventilation cavity. The upper end of the partition plate is provided with an opening, and the opening is configured to communicate the liquid storage cavity with the ventilation cavity. The liquid storage cavity is located directly below the communicating hole of the atomizing housing. The ventilation cavity is located away from the underside of the communicating hole of the atomizing housing. The bottom wall of the atomizing base is provided with at least one ventilation hole, and the ventilation hole is located in the ventilation cavity.

Further, the bottom wall of the ventilation cavity is provided with a fence surrounding the outer periphery of the ventilation hole.

Further, there are two partition plates provided in the inner cavity of the atomizing base. The two partition plates divide the inner cavity of the atomizing base into the liquid storage cavity and two ventilation cavities. The liquid storage cavity is located between the two partition plates. There are two ventilation holes provided on the bottom wall of the atomizing base, and one ventilation hole corresponds to one ventilation cavity.

Further, the atomizer further includes a liquid storage casing. A liquid storage chamber is provided in the liquid storage casing. The upper end of the liquid storage casing is provided with a mouthpiece. The lower end of the liquid storage casing is sleeved on the outside of the atomizing base. The lower end of the atomizing housing is provided with a silicone sealing device. The silicone sealing device is arranged between the atomizing housing and the atomizing base. The side wall of the silicone sealing device is in contact with the inner surface of the liquid storage casing for sealing the lower end of the liquid storage casing. The silicone sealing device is provided with the communicating hole to allow the atomizing chamber to communicate with the inner cavity of the atomizing base.

Further, an air guiding tube is provided in the liquid storage casing. The upper end of the atomizing housing is connected to and communicated with the air guiding tube.

The present disclosure provides an aerosol generating device which includes the atomizer as described above.

Further, the aerosol generating device further includes a battery rod. The battery rod includes a battery rod shell and a battery holder installed in the battery rod shell. The upper end of the battery holder is mounted with an airflow guiding device. The airflow guiding device is provided with an air intake channel. The downstream end of the air intake channel of the airflow guiding device communicates with the ventilation hole of the atomizing base. An airflow switch device is provided on the battery holder. The battery rod shell is provided with an air intake hole, and the air intake hole communicates with the upstream end of the air intake channel of the airflow guiding device through the airflow switch device.

Further, the battery rod shell is sleeved on the outside of the atomizer, the bottom of the atomizing base abuts against the airflow guiding device, and the ventilation hole communicates with the downstream end of the air intake channel.

Further, the outer surface of the airflow guiding device is provided with an airflow guiding groove. When the bottom of the atomizing base abuts against the airflow guiding device, one segment of the air intake channel is formed between the bottom end surface of the atomizing base and the airflow guiding groove on the end surface of the airflow guiding device, and another segment of the air intake channel is formed between the inner surface of the battery rod shell and the airflow guiding groove on the side surface of the airflow guiding device.

Further, the airflow guiding device includes a main body. The main body is located between the bottom of the atomizing base and the upper end of the battery holder. The main body is provided with an extension part. The extension part is provided with one segment of the air intake channel, and the segment of the air intake channel on the extension part communicates with another segment of the air intake channel provided on the main body, wherein the segment of the air intake channel provided on the main body communicates with the ventilation hole, and the segment of the air intake channel on the extension part communicates with the air intake hole through the airflow switch device.

The beneficial effects of the present disclosure are as follows: the axis of the ventilation hole of the atomizing base of this disclosure is located outside the air passage of the sealing device, the bottom wall of the atomizing base is provided with a fence surrounding the outer periphery of the ventilation hole. In this way, it is not a straight-through air intake between the ventilation hole of the atomizing base and the air passage of the sealing device. The airflow flowing out from the ventilation hole of the atomizing base needs to be turned and then enters the atomizing chamber of the atomizing housing through the air passage of the sealing device. During the atomization process, the condensate in the atomizing chamber of the atomizing housing directly flows into the liquid storage cavity of the atomizing base located directly below the atomizing chamber, and will not directly flow into the ventilation cavity, and also will not flow into the bottom of the atomizing base through the ventilation hole, thereby realizing double anti-leakage.

In present disclosure, the airflow switch device is installed on the upper end of the battery holder, an air intake hole is provided in the side wall of the battery rod shell to realize air intake, and the air intake hole on the battery rod shell communicates with the upstream end of the air intake channel of the airflow guiding device through the airflow switch device. Thus, the air intake in this solution is not affected by the battery assembly inside the battery rod, and the air intake channel of the aerosol generating device is relatively short, which can effectively ensure the smoothness of the user's inhalation and provide a good user experience.

BRIEF DESCRIPTION OF THE DRAWINGS

In order to more clearly illustrate the technical solutions in the embodiments of the present disclosure or the prior art, the accompanying drawings that need to be used in the description of the embodiments or the prior art will be briefly introduced below. Obviously, the accompanying drawings in the following description are only some embodiments of the present disclosure, and for those skilled in the art, other drawings can also be obtained based on these drawings without creative effort.

Figure 1:
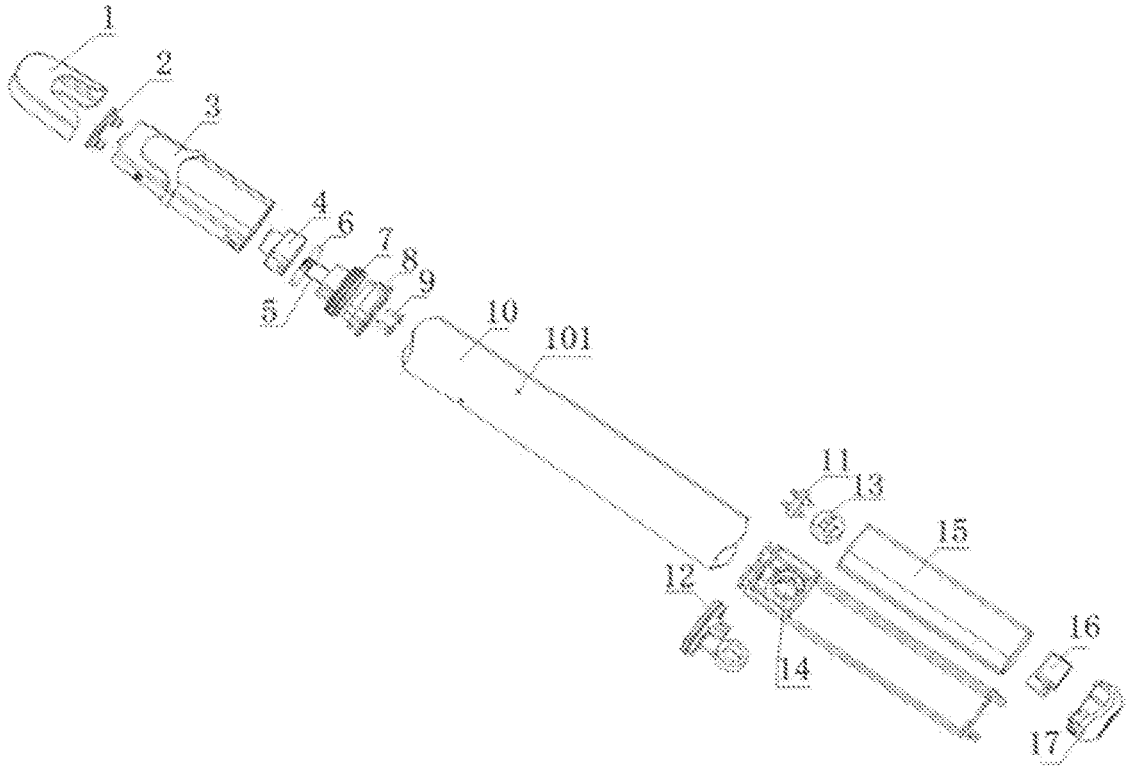
FIG. 1 is an exploded schematic view of the aerosol generating device of the present disclosure.

| | |
|---|---|
| mouthpiece cap 1 | opening 86 |
| sealing plug 2 | contact pin 9 |
| liquid storage casing 3 | battery rod shell 10 |
| air guiding tube 31 | air intake hole 101 |
| mouthpiece 32 | ejector pin 11 |
| liquid storage chamber 33 | airflow guiding device 12 |
| atomizing housing 4 | main body 121 |
| atomizing chamber 41 | first extension part 122 |
| heating wire 5 | second extension part 123 |
| liquid guiding member 6 | airflow guiding groove 124 |
| silicone sealing device 7 | vent hole 142 |
| atomizing base 8 | airflow switch device 13 |
| ventilation hole 81 | battery holder 14 |
| partition plate 82 | mounting hole 141 |
| liquid storage cavity 83 | battery assembly 15 |
| ventilation cavity 84 | charging port 16 |
| fence 85 | tail cap 17 |

DETAILED DESCRIPTION OF THE APPLICATION

The technical solutions in the embodiments of the present disclosure will be clearly and completely described below. Obviously, the described embodiments are only some embodiments of the present disclosure, not all embodiments. Based on the embodiments in the present disclosure, all other embodiments obtained by persons of ordinary skill in the art without making creative work shall fall into the protection scope of the present disclosure.

First Embodiment

Figure 5:
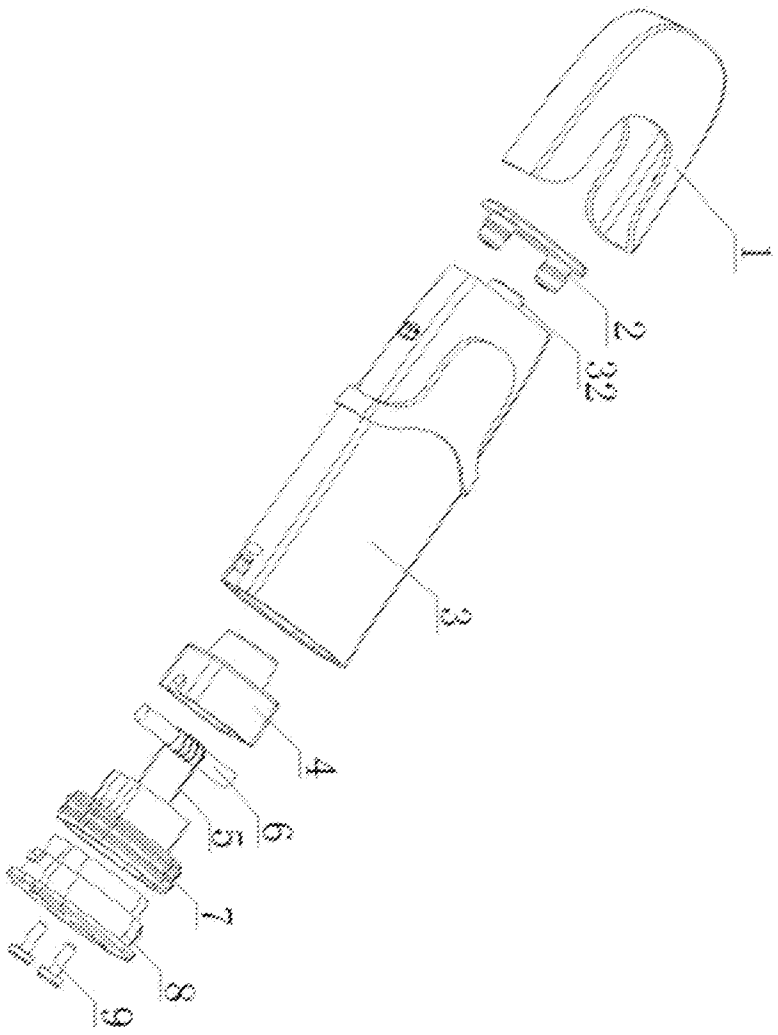
FIG. 5 is an exploded schematic view of the atomizer of the present disclosure.
Figure 6:
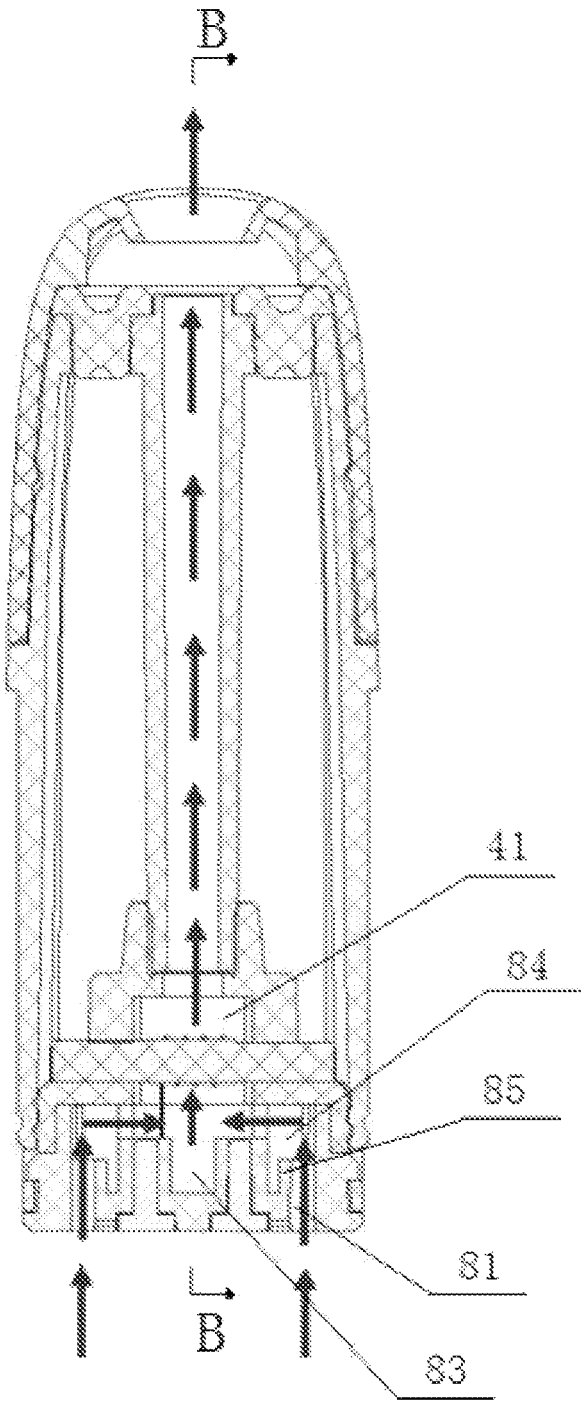
FIG. 6 is a cross-sectional schematic view of the atomizer of the present disclosure.
Figure 7:
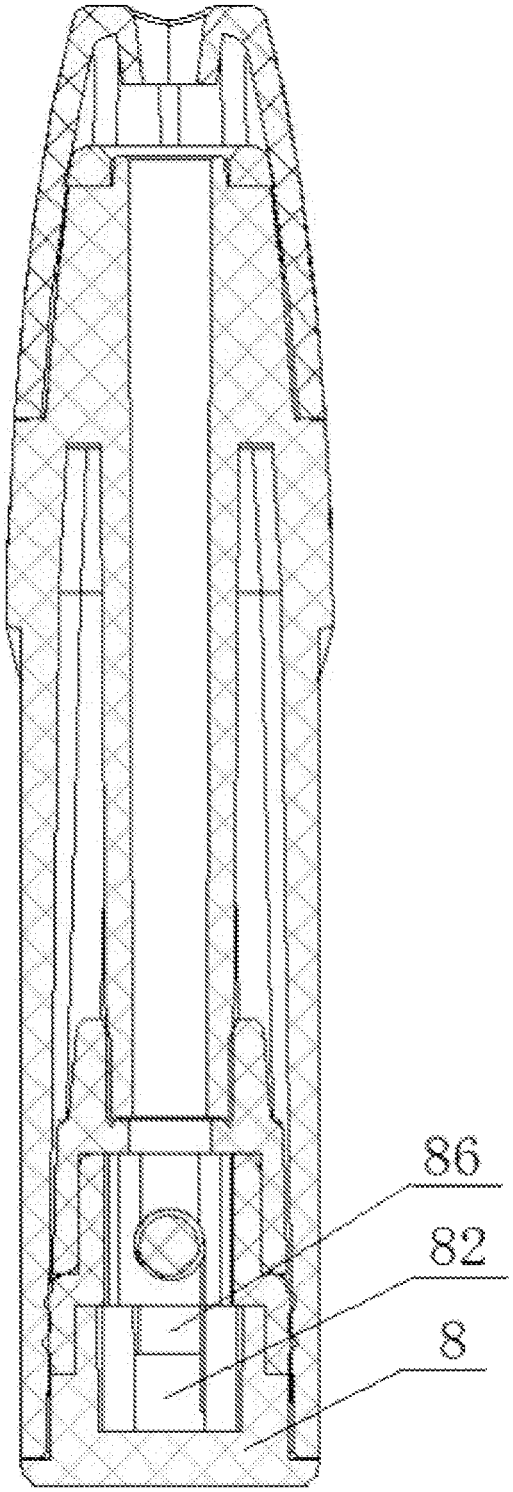
FIG. 7 is a cross-sectional view along line B-B of FIG. 6.
Figure 8:
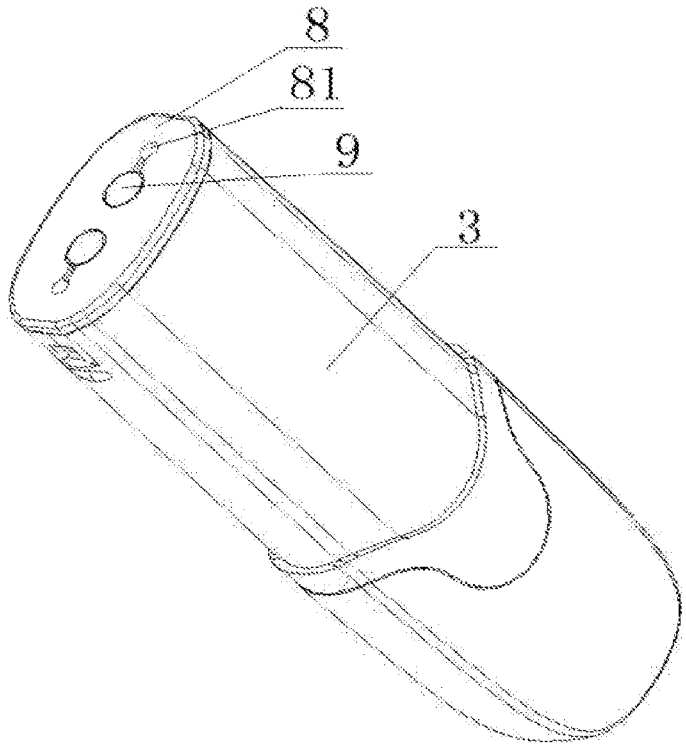
FIG. 8 is an outline drawing of the atomizer of the present disclosure.
Figure 9:
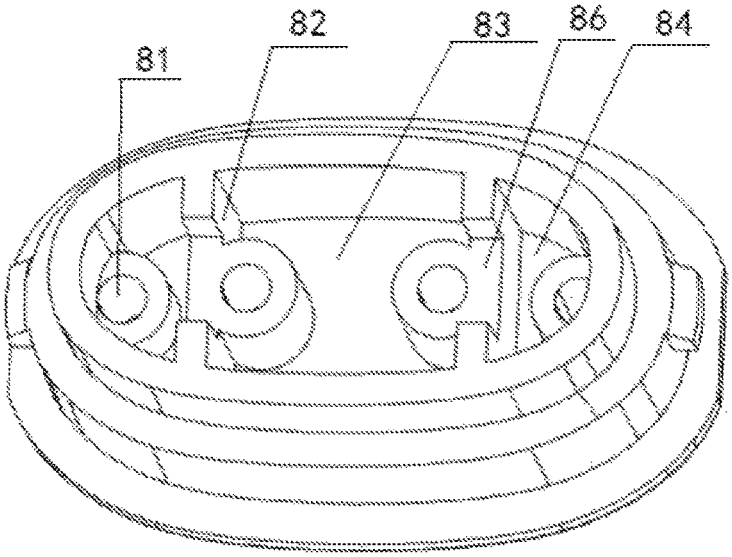
FIG. 9 is a structural schematic view of the atomizing base of the atomizer of the present disclosure.

Referring to FIG. 5 to FIG. 9, this embodiment discloses an atomizer, including an atomizing housing 4 and an atomizing base 8. The lower end of the atomizing housing 4 is connected to the upper end of the atomizing base 8. The bottom of the atomizing housing 4 is provided with a communicating hole (not labelled) to allow an atomizing chamber 41 in the atomizing housing 4 to communicate with the inner cavity of the atomizing base 8. A partition plate 82 is provided in the inner cavity of the atomizing base 8, and the partition plate 82 divides the inner cavity of the atomizing base 8 into a liquid storage cavity 83 and a ventilation cavity 84. The upper end of the partition plate 82 is provided with an opening 86, and the opening 86 is configured to communicate the liquid storage cavity 83 with the ventilation cavity 84. The liquid storage cavity 83 is located directly below the communicating hole of the atomizing housing 4. The ventilation cavity 84 is located away from the underside of the communicating hole of the atomizing housing 4. The bottom wall of the atomizing base 8 is provided with at least one ventilation hole 81. The ventilation hole 81 is located in the ventilation cavity 84.

Further, the bottom wall of the ventilation cavity 84 is provided with a fence 85 surrounding the outer periphery of the ventilation hole 81. The fence 85 protrudes upwardly from the upper surface of the bottom wall of the ventilation cavity 84. By setting the fence 85, the present disclosure can realize double anti-leakage. The height of the fence 85 is set according to actual needs.

Further, there are two partition plates 82 provided in the inner cavity of the atomizing base 8, and the two partition plates 82 divide the inner cavity of the atomizing base 8 into a liquid storage cavity 83 and two ventilation cavities 84. The liquid storage cavity 83 is located between the two partition plates 82. The liquid storage cavity 83 is located directly below the atomizing chamber 41 of the atomizing housing 4 and therefore is aligned with the atomizing chamber 41 along the axial direction of the atomizer. The two ventilation cavities 84, which are located at two opposite sides of the liquid storage cavity 83, are deviated from and therefore are not aligned with the atomizing chamber 41 along the axial direction of the atomizer. There are two ventilation holes 81 provided on the bottom wall of the atomizing base 8, and one ventilation hole 81 corresponds to one ventilation cavity 84.

Further, the atomizer of the present disclosure further includes a liquid storage casing 3, and a liquid storage chamber 33 is provided in the liquid storage casing 3. The upper end of the liquid storage casing 3 is provided with a mouthpiece 32. The lower end of the atomizing housing 4 is provided with a silicone sealing device 7. The silicone sealing device 7 is arranged between the atomizing housing 4 and the atomizing base 8, and the side wall of the silicone sealing device 7 is in contact with the inner surface of the liquid storage casing 3 for sealing the lower end of the liquid storage casing 3. The silicone sealing device 7 is provided with the communicating hole to allow the atomizing chamber 41 to communicate with the inner cavity of the atomizing base 8.

Further, an air guiding tube 31 is provided in the liquid storage casing 3. The upper end of the atomizing housing 4 is connected to and communicated with the air guiding tube 31. The space between the air guiding tube 31 and the inner surface of the liquid storage casing 3 forms a liquid storage chamber 33. The lower end of the liquid storage casing 3 is clamped with the atomizing base 8. The outer surface of the side wall of the atomizing base 8 is provided with clamping protrusions for clamping with the liquid storage casing 3. A liquid guiding member 6 is provided in the atomizing housing 4. At least one end of the liquid guiding member 6 extends into the liquid storage chamber 33 of the liquid storage casing 3. A heating wire 5 is wound on the liquid guiding member 6, and the heating wire 5 is located in the atomizing chamber 41 of the atomizing housing 4.

In this embodiment, the liquid guiding member 6 is strip-shaped. The air guiding tube 31 communicates with the mouthpiece 32.

In this embodiment, the liquid storage cavity 83 of the atomizing base 8 is located directly below the communicating hole of the silicone sealing device 7, and the ventilation cavity 84 is located away from the underside of the communicating hole of the silicone sealing device 7. During the atomization process, the condensate in the atomizing chamber 41 of the atomizing housing 4 directly flows into the liquid storage cavity 83 of the atomizing base 8 located directly below the atomizing chamber 41, and will not directly flow into the ventilation cavity 84, and also will not flow into the bottom of the atomizing base 8 through the ventilation hole 81.

The upper end of the liquid storage casing 3 is provided with a liquid injection hole (not labelled), and a sealing plug 2 is fitted in the liquid injection hole. The sealing plug 2 is configured to seal the liquid injection hole. By setting the liquid injection hole at the upper end of the liquid storage casing 3, it is convenient for the user to add e-liquid. The sealing plug 2 can be a silicone sealing plug.

A mouthpiece cap 1 is connected to the upper end of the liquid storage casing 3 by clamping connection.

The atomizing base 8 includes a bottom wall and a side wall surrounding the bottom wall and extending upwardly from the bottom wall. The side wall and the bottom wall jointly define the inner cavity of the atomizing base 8. In this embodiment, the inner cavity of the atomizing base 8 is oval.

A contact pin 9 is fixed on the bottom wall of the atomizing base 8. The contact pin 9 passes through a contact pin installation hole (not labelled) and penetrates the bottom wall of the atomizing base 8. One end of the contact pin 9 is electrically connected with the heating wire 5, and the other end of the contact pin 9 is used to electrically connect with an ejector pin in a battery rod. The ejector pin is electrically connected with a circuit board. The bottom wall of the atomizing base 8 is provided with a fence (not labelled) surrounding the outer periphery of the contact pin installation hole. The fence protrudes upwardly from the upper surface of the bottom wall of the atomizing base 8. The height of the fence is set according to actual needs. The contact pin 9 is prevented from being soaked in the e-liquid by setting the fence, and the e-liquid is also prevented from leaking through the gap between the contact pin 9 and the atomizing base 8. The contact pin 9 has a stepped cylindrical shape to prevent the e-liquid from flowing out from the contact pin installation hole.

Second Embodiment

Figure 2:
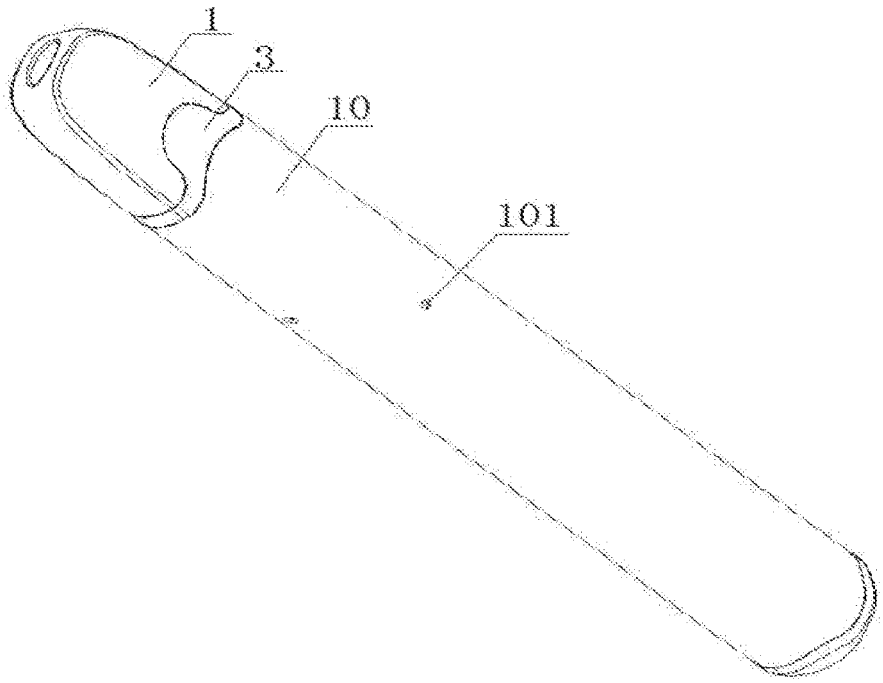
FIG. 2 is an outline drawing of the aerosol generating device of the present disclosure.
Figure 3:
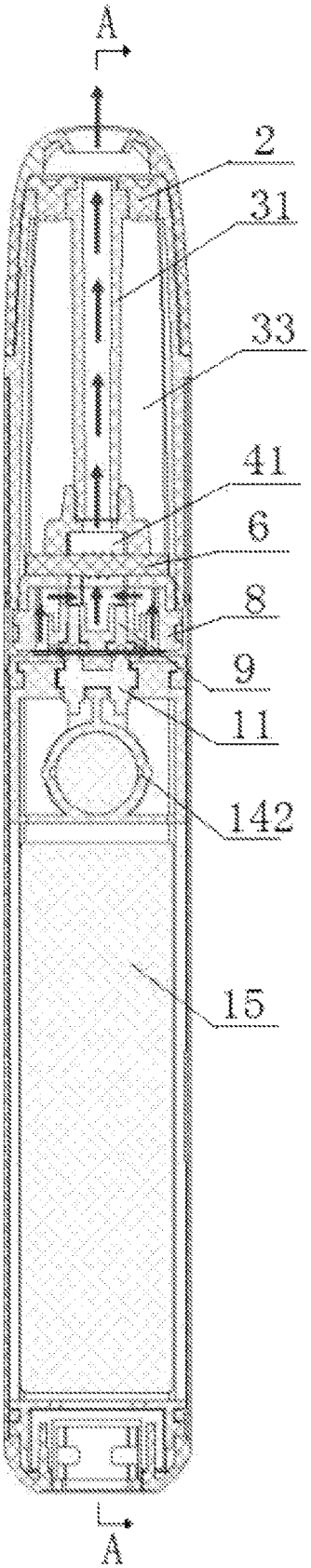
FIG. 3 is a cross-sectional schematic view of the aerosol generating device of the present disclosure.
Figure 4:
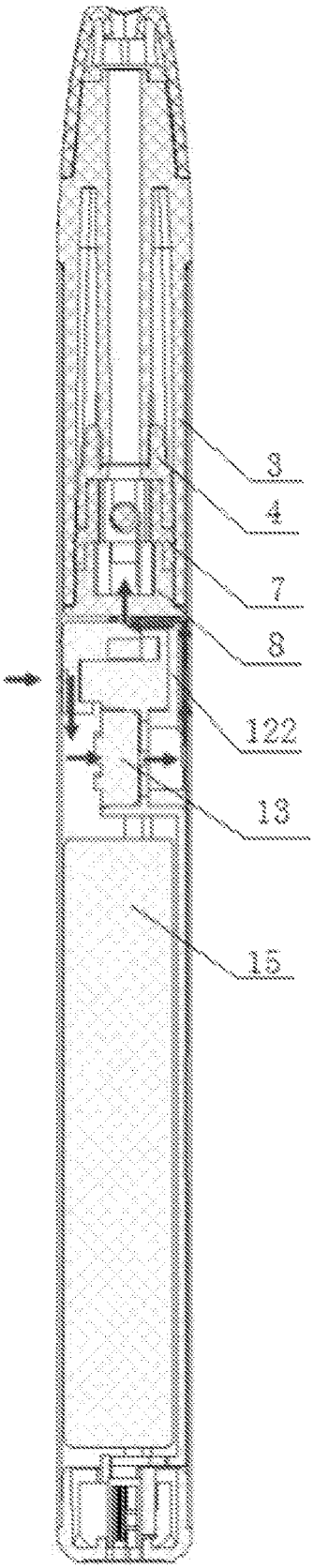
FIG. 4 is a cross-sectional view along line A-A of FIG. 3.
Figure 10:
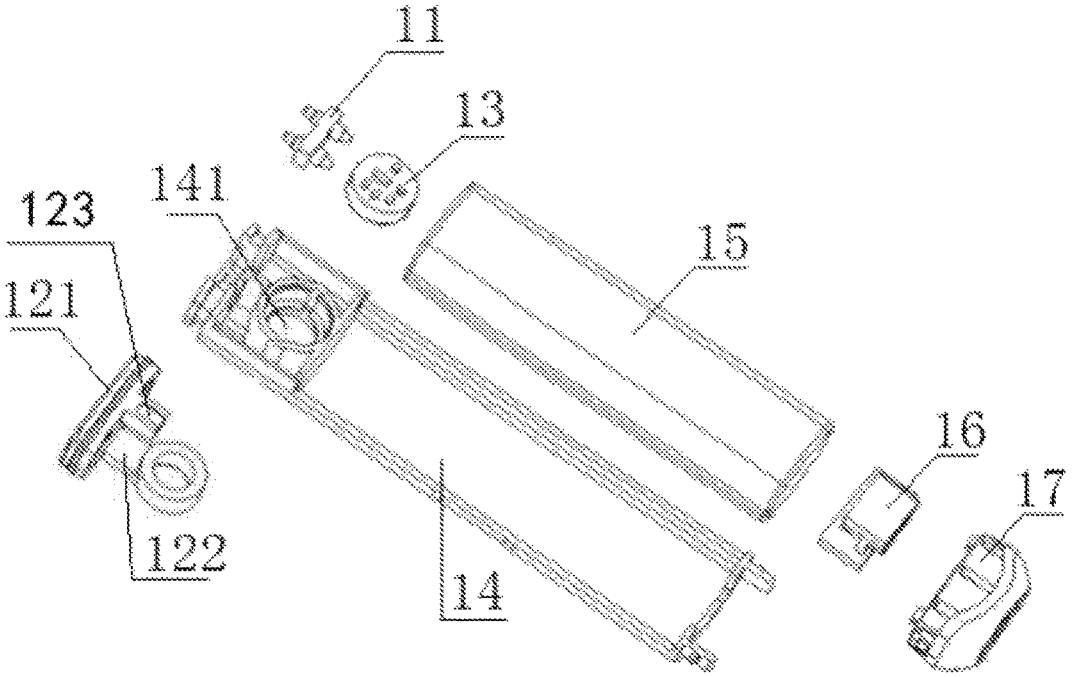
FIG. 10 is an exploded schematic view of the battery rod of the aerosol generating device of the present disclosure (the housing of the battery rod is not shown)
Figure 11:
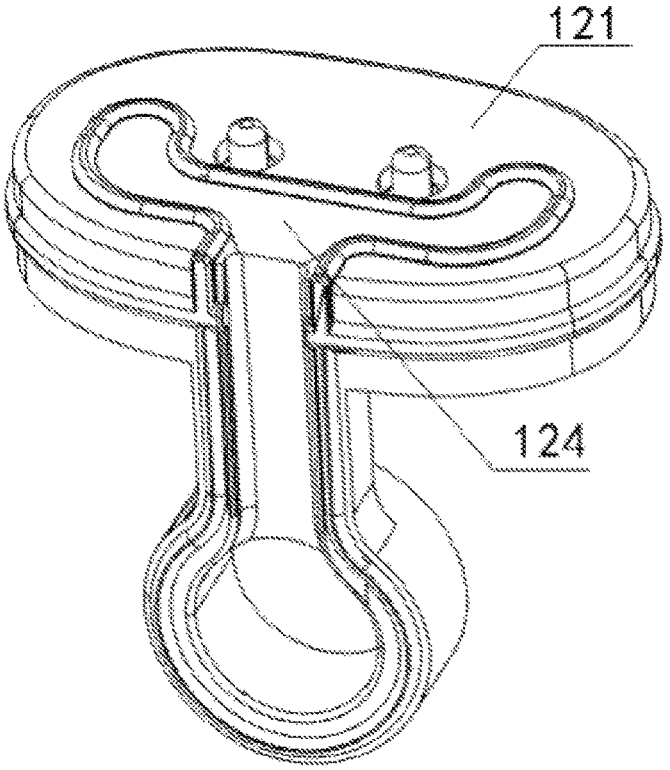
FIG. 11 is a structural schematic view of the airflow guiding device of the atomizer of the present disclosure.

Referring to FIG. 1 to FIG. 11, this embodiment discloses an aerosol generating device, including the atomizer described in the first embodiment.

Further, the aerosol generating device of the present disclosure includes a battery rod. The battery rod includes a battery rod shell 10 and a battery holder 14 installed in the battery rod shell 10. The upper end of the battery holder 14 is mounted with an airflow guiding device 12. The airflow guiding device 12 is provided with an air intake channel (not labelled), and the downstream end of the air intake channel of the airflow guiding device 12 communicates with the ventilation hole 81 of the atomizing base 8. An airflow switch device 13 is provided on the battery holder 14. The battery rod shell 10 is provided with an air intake hole 101. The air intake hole 101 communicates with the upstream end of the air intake channel of the airflow guiding device 12 through the airflow switch device 13.

Specifically, the battery holder 14 is provided with a mounting hole 141 for receiving the airflow switch device 13. The side wall of the mounting hole 141 is provided with a vent hole 142, which is used to communicate the air intake hole 101 with the air intake channel of the airflow guiding device 12. Of course, the vent hole 142 can also be provided on the airflow switch device 13 for communicating the air intake hole 101 with the air intake channel of the airflow guiding device 12.

The airflow switch device 13 includes a circuit board (not labelled) and an airflow switch (not labelled) provided on the circuit board. The vent hole 142 may be provided on the circuit board. A control circuit of the aerosol generating device can also be provided on the circuit board. The battery assembly 15 is connected to the circuit board.

A battery assembly 15 is mounted on the battery holder 14.

Preferably, the battery rod shell 10 of the battery rod is sleeved on the outside of the atomizer, and is clamped with the side wall of the atomizer, so that the bottom of the atomizing base 8 abuts against the airflow guiding device 12 at the upper end of the battery holder 14, and the ventilation hole 81 at the bottom of the atomizing base 8 communicates with the downstream end of the air intake channel of the airflow guiding device 12.

There are two designs of the air intake channel on the airflow guiding device 12. One design is that the outer surface of the airflow guiding device 12 is provided with an airflow guiding groove 124. When the bottom of the atomizing base 8 abuts against the airflow guiding device 12 at the upper end of the battery holder 14, one segment of the air intake channel is formed between the bottom end surface of the atomizing base 8 and the airflow guiding groove 124 on the end surface of the airflow guiding device 12, and another segment of the air intake channel is formed between the inner surface of the battery rod shell 10 and the airflow guiding groove 124 on the side surface of the airflow guiding device 12.

The other design is that the air intake channel is provided inside the airflow guiding device 12. Of course, the two designs can also be used in combination. In this embodiment, the outer surface of the airflow guiding device 12 is provided with strip-shaped protrusions, and the airflow guiding groove 124 is surrounded by the strip-shaped protrusions.

Preferably, the airflow guiding device 12 includes a main body 121, and the main body 121 is located between the bottom of the atomizing base 8 and the upper end of the battery holder 14. One side of the main body 121 is provided with a first extension part 122, the first extension part 122 is inserted into a clamping slot (not labelled) provided on the battery holder 14, and the distal end of the first extension part 122 is embedded in the mounting hole 141 at the back side of the airflow switch device 13. The first extension part 122 is provided with one segment of the air intake channel, the segment of the air intake channel on the first extension part 122 communicates with another segment of the air intake channel provided on the main body 121. The segment of the air intake channel provided on the main body 121 communicates with the ventilation hole 81 at the bottom of the atomizing base 8. The segment of the air intake channel provided on the first extension part 122 communicates with the vent hole 142.

In this embodiment, the distal end of the first extension part 122 is provided with a hollow cylinder (not labelled). The hollow cylinder at the distal end of the first extension part 122 is embedded in the mounting hole 141 and is located at the back side of the airflow switch device 13. The outer surface of the first extension part 122 is provided with the airflow guiding groove 124, and the upper end surface of the main body 121 is provided with the airflow guiding groove 124, thus forming a semi-closed air intake channel. The main body 121 of the airflow guiding device 12 is elliptical, which is adapted to the shape of the atomizing base 8. The other side of the main body 121 is further provided with a second extension part 123 corresponding to the air intake hole 101 in the side wall of the battery rod shell 10. This extension part 123 is also provided with an airflow guiding groove (not labelled) for communicating the air intake hole 101 in the side wall of the battery rod shell 10 with the airflow switch device 13. The mounting hole 141 is a cylindrical through hole. A positioning step is provided in the mounting hole 141 for positioning the airflow switch device 13. The first extension part 122 and the second extension part 123 of the main body 121 are arranged in parallel.

In this embodiment, each of the main body 121, the first extension part 122 and the second extension part 123 is provided with an airflow guiding groove 124. The external air enters the battery rod shell 10 from the air intake hole 101, then flows downwardly along the airflow guiding groove (not labelled) on the second extension part 123, flows radially through the airflow switch device 13 to reach the lower end of the first extension part 122, flows upwardly along the airflow guiding groove 124 on the first extension part 122 to reach the main body 121, flows radially along the airflow guiding groove 124 on the main body 121 to reach the ventilation hole 81 of the atomizing base 8, flows upwardly along the ventilation hole 81, flows radially through the opening 86 of the partition plate 82 to reach the liquid storage cavity 83, and flows upwardly through the communicating hole to reach the atomizing chamber 41 of the atomizing housing 4 in sequence.

Preferably, the airflow guiding device 12 is made of silicone material.

The mounting hole 141 is located at the upper end of the battery holder 14. The lower end of the battery holder 14 is provided with a charging port 16, and the battery assembly 15 is arranged between the charging port 16 and the airflow switch device 13. A tail cap 17 may be provided at the lower end of the battery holder 14.

Preferably, the airflow guiding device 12 is provided with an ejector pin hole (not labelled) for the ejector pin 11 to pass through, and the ejector pin 11 is fitted in the ejector pin hole. The ejector pin 11 on the airflow guiding device 12 abuts against the contact pin 9 provided at the bottom of the atomizing base 8, to electrically connect the contact pin 9 provided at the bottom of the atomizing base 8 with the battery assembly 15. The contact pin 9 provided at the bottom of the atomizing base 8 is electrically connected with the heating wire 5.

The battery rod shell 10 of the battery rod is sleeved at the outside of the lower end of the liquid storage casing 3, and is clamped with the liquid storage casing 3, so that the bottom of the atomizing base 8 is in contact with the airflow guiding device 12 at the upper end of the battery holder 14. At this time, the downstream end of the air intake channel of the airflow guiding device 12 communicates with the ventilation hole 81 of the atomizing base 8.

The above is only the preferred embodiments of the present disclosure and is not intended to limit the present disclosure. Any modifications, equivalent replacements, improvements, etc. made within the spirit and principles of the present disclosure should be included in the protection scope of the present disclosure.

What is claimed is:

1. An atomizer comprising an atomizing housing and an atomizing base, wherein a lower end of the atomizing housing is connected to an upper end of the atomizing base, a bottom of the atomizing housing is provided with a communicating hole to allow an atomizing chamber in the atomizing housing to communicate with an inner cavity of the atomizing base, the atomizing base comprises a bottom wall and a peripheral side wall surrounding the bottom wall and extending upwardly from the bottom wall, the peripheral side wall and the bottom wall jointly define the inner cavity of the atomizing base, two partition plates are provided in the inner cavity of the atomizing base, the two partition plates are spaced apart from each other, wherein each partition plate is connected to the bottom wall and the peripheral side wall of the atomizing base, the two partition plates divide the inner cavity of the atomizing base into a liquid storage cavity and two ventilation cavities, the liquid storage cavity is located between the two partition plates, wherein the liquid storage cavity is formed and enclosed by the bottom wall of the atomizing base, the peripheral side wall of the atomizing base and the two partition plates, and each ventilation cavity is formed and enclosed by the bottom wall of the atomizing base, the peripheral side wall of the atomizing base and a corresponding partition plate, an upper end of each partition plate is recessed downwardly towards the bottom wall of the atomizing base to be provided with an opening, and the opening is configured to communicate the liquid storage cavity with the ventilation cavity, the liquid storage cavity is located directly below the communicating hole of the atomizing housing, the ventilation cavity is located away from the underside of the communicating hole of the atomizing housing such that condensate in the atomizing chamber does not directly flow into the ventilation cavity, the bottom wall of the atomizing base is provided with two ventilation holes, the two ventilation holes are respectively located in the two ventilation cavities, and one ventilation hole corresponds to one ventilation cavity.

2. The atomizer according to claim 1, wherein the bottom wall of the ventilation cavity is provided with a fence surrounding an outer periphery of the ventilation hole.

3. The atomizer according to claim 1, further comprising a liquid storage casing, wherein a liquid storage chamber is provided in the liquid storage casing, an upper end of the liquid storage casing is provided with a mouthpiece, a lower end of the liquid storage casing is sleeved on an outside of the atomizing base, the lower end of the atomizing housing is provided with a silicone sealing device, the silicone sealing device is arranged between the atomizing housing and the atomizing base, a side wall of the silicone sealing device is in contact with an inner surface of the liquid storage casing for sealing the lower end of the liquid storage casing, the silicone sealing device is provided with the communicating hole to allow the atomizing chamber to communicate with the inner cavity of the atomizing base.

4. The atomizer according to claim 3, wherein an air guiding tube is provided in the liquid storage casing, an upper end of the atomizing housing is connected to and communicated with the air guiding tube.

5. The atomizer according to claim 3, wherein a liquid guiding member is provided in the atomizing housing, a heating wire is wound on the liquid guiding member, a contact pin is fixed on the bottom wall of the atomizing base, a contact pin installation hole is provided on the bottom wall of the atomizing base, and the contact pin passes through the contact pin installation hole to be electrically connected with the heating wire.

6. The atomizer according to claim 5, wherein the bottom wall of the atomizing base is provided with a fence surrounding an outer periphery of the contact pin installation hole.

7. An aerosol generating device comprising the atomizer according to claim 1.

8. The aerosol generating device according to claim 7, further comprising a battery rod, wherein the battery rod comprises a battery rod shell and a battery holder installed in the battery rod shell, an upper end of the battery holder is mounted with an airflow guiding device, the airflow guiding device is provided with an air intake channel, a downstream end of the air intake channel of the airflow guiding device communicates with the ventilation hole of the atomizing base, an airflow switch device is provided on the battery holder, the battery rod shell is provided with an air intake hole, and the air intake hole communicates with an upstream end of the air intake channel of the airflow guiding device through the airflow switch device.

9. The aerosol generating device according to claim 8, wherein the battery rod shell is sleeved on an outside of the atomizer, the bottom of the atomizing base abuts against the airflow guiding device, and the ventilation hole communicates with the downstream end of the air intake channel.

10. The aerosol generating device according to claim 8, wherein an outer surface of the airflow guiding device is provided with an airflow guiding groove; when the bottom of the atomizing base abuts against the airflow guiding device, one segment of the air intake channel is formed between a bottom end surface of the atomizing base and the airflow guiding groove on an end surface of the airflow guiding device, and another segment of the air intake channel is formed between an inner surface of the battery rod shell and the airflow guiding groove on a side surface of the airflow guiding device.

11. The aerosol generating device according to claim 8, wherein the airflow guiding device comprises a main body, the main body is located between the bottom of the atomizing base and the upper end of the battery holder, the main body is provided with an extension part, the extension part is provided with one segment of the air intake channel, the segment of the air intake channel on the extension part communicates with another segment of the air intake channel provided on the main body, wherein the segment of the air intake channel provided on the main body communicates with the ventilation hole, and the segment of the air intake channel on the extension part communicates with the air intake hole through the airflow switch device.

12. The aerosol generating device according to claim 8, wherein the airflow guiding device comprises a main body, and a first extension part and a second extension part extending downwardly from two opposite sides of the main body respectively, each of the main body, the first extension part and the second extension part is provided with an airflow guiding groove, wherein the external air enters the battery rod shell from the air intake hole, then flows downwardly along the airflow guiding groove on the second extension part, flows radially through the airflow switch device to reach a lower end of the first extension part, flows upwardly along the airflow guiding groove on the first extension part to reach the main body, flows radially along the airflow guiding groove on the main body to reach the ventilation hole of the atomizing base, flows upwardly along the ventilation hole, flows radially through the opening of the partition plate to reach the liquid storage cavity, and flows upwardly through the communicating hole to reach the atomizing chamber of the atomizing housing in sequence.

13. The aerosol generating device according to claim 12, wherein the upper end of the battery holder is provided with a mounting hole, the airflow switch device is mounted in the mounting hole, a lower end of the first extension part is provided with a hollow cylinder which is embedded in the mounting hole and located at a back side of the airflow switch device.

14. The aerosol generating device according to claim 13, wherein a side wall of the mounting hole is provided with a vent hole which is configured to communicate the air intake hole with the air intake channel of the airflow guiding device.

15. The aerosol generating device according to claim 1, wherein each partition plate is disposed within the inner cavity of the atomizing base, with a bottom of each partition plate connected to the bottom wall of the atomizing base, and opposite sides of each partition plate connected to the peripheral side wall of the atomizing base.

16. The aerosol generating device according to claim 1, wherein each partition plate has a height the same as the peripheral side wall of the atomizing base, such that an upper end face of each partition plate is flush with an upper end face of the peripheral side wall of the atomizing base.

* * * * *